US005605226A

United States Patent [19]

Hernlein

[11] Patent Number: 5,605,226

[45] Date of Patent: Feb. 25, 1997

[54] CADDY

[76] Inventor: William J. Hernlein, 1929 Wilcox Ave. #2, Los Angeles, Calif. 90068

[21] Appl. No.: 387,575

[22] Filed: Feb. 13, 1995

[51] Int. Cl.[6] ..... A24F 19/10

[52] U.S. Cl. ..... 206/86; 206/496; 220/375

[58] Field of Search ..... 206/85–89, 134–136, 206/236, 246, 496, 37, 38; 220/212, 212.5, 375, 379, 744

[56] References Cited

U.S. PATENT DOCUMENTS

| | | | |
|---|---|---|---|
| 1,587,468 | 6/1926 | Burkey et al. . | |
| 1,992,421 | 2/1935 | Gottfried | 131/51 |
| 2,572,863 | 10/1951 | Jaap | 206/246 |
| 2,582,598 | 1/1952 | McGuire | 131/234 |
| 2,715,961 | 8/1955 | Field | 206/38 |
| 2,777,569 | 1/1957 | Starke, Jr. | 206/38 |
| 3,033,414 | 5/1962 | Galland | 220/375 |
| 3,888,264 | 6/1975 | Baclit | 131/235 R |
| 4,190,148 | 2/1980 | Schade, II et al. | 206/89 |
| 4,252,237 | 2/1981 | Baclit | 206/246 |
| 4,588,076 | 5/1986 | Caputo et al. | 206/86 |
| 4,789,059 | 12/1988 | Kim | 206/246 |
| 4,993,435 | 2/1991 | McCann | 131/330 |
| 5,145,097 | 9/1992 | Lowe | 220/375 |

*Primary Examiner*—Jimmy G. Foster
*Attorney, Agent, or Firm*—Frank L. Zugelter

[57] ABSTRACT

A convenience caddy (20) primarily for a smoker's use. The caddy (20) includes a body (21) and its inseparable lid (24) joined together by an elastic connection in the form of a bungee cord (47) or a coiled spring (64). A lower end of the connection is pivotally connected midway of and to the body (21), and having its upper end pivotally connected to the lid (24) within a hollow chamber (50) formed in it. The bungee cord (47) is disposed in a longitudinal slot (38 ) along one face (39) in the body (21) and traverse along a trajectory generated by removing the lid (24), against the bliss of the bungee cord (47), from the top of the body (21) and swinging it down to the bottom of the body (21) where it is seated, out of the way of lighter unit (30) mounted in a pocket (27) in the body (21) and another pocket (26) for ashes, butts, and filters. Mouths (59) in the lid (24) provide a holding member for lighted cigarettes when not held by the smoker. An alternate embodiment includes clip members (62). Gaskets (69) maintain a seal for the pocket (26) to prevent the odor of ashes (28), etc., from emanating from the caddy (20). Retaining clips (116) provide holding of lighter units (30) to the caddy (20). The caddy (20) also can function, primarily in a larger scaled version, as a carrying or storage case for all kinds of articles with one or more pockets.

25 Claims, 5 Drawing Sheets

5
24
20
22
35
21
23
57
33
46
26
34
32
30
31
38
27
41
39
53
59
60
29
28

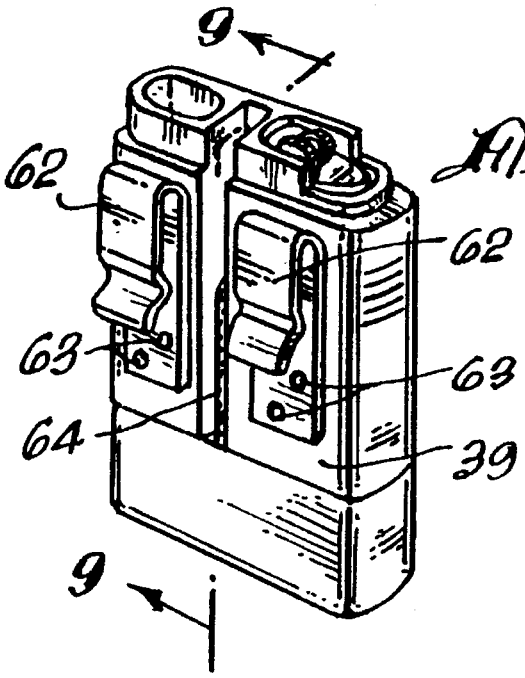
FIG. 8.
FIG. 9.
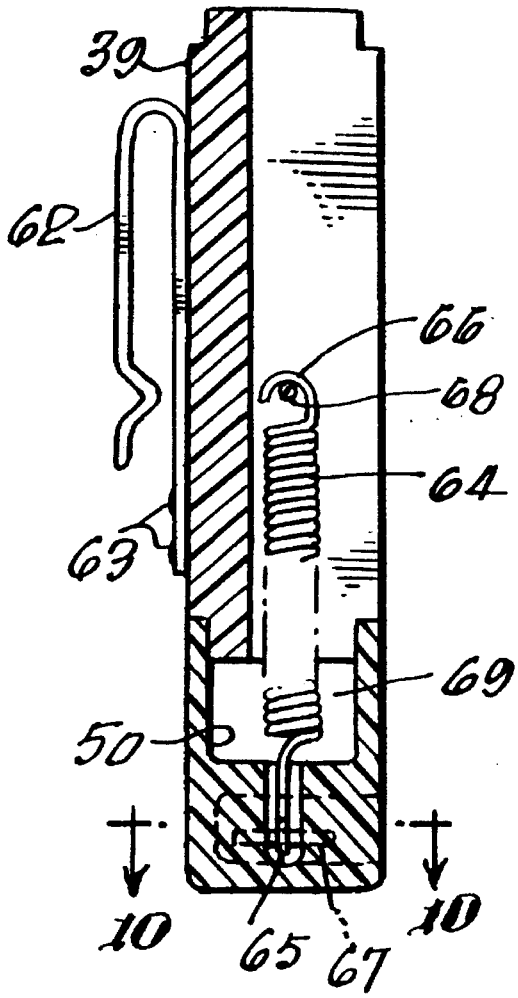
FIG. 10.
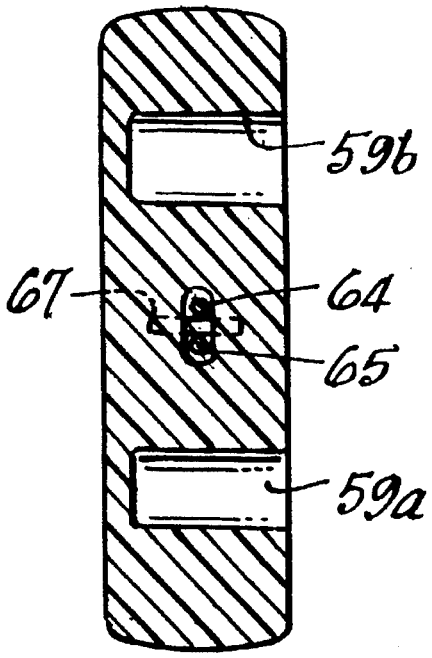

FIG. 11.
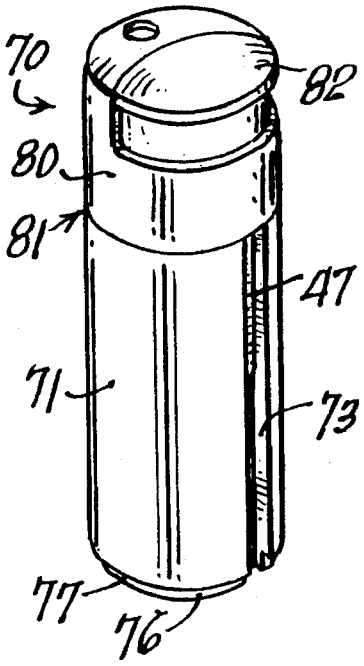
FIG. 12.
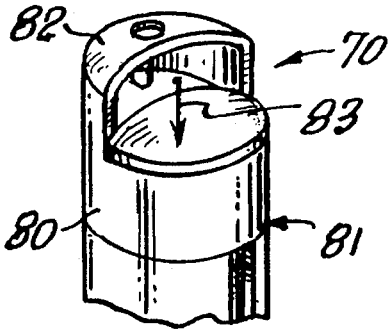
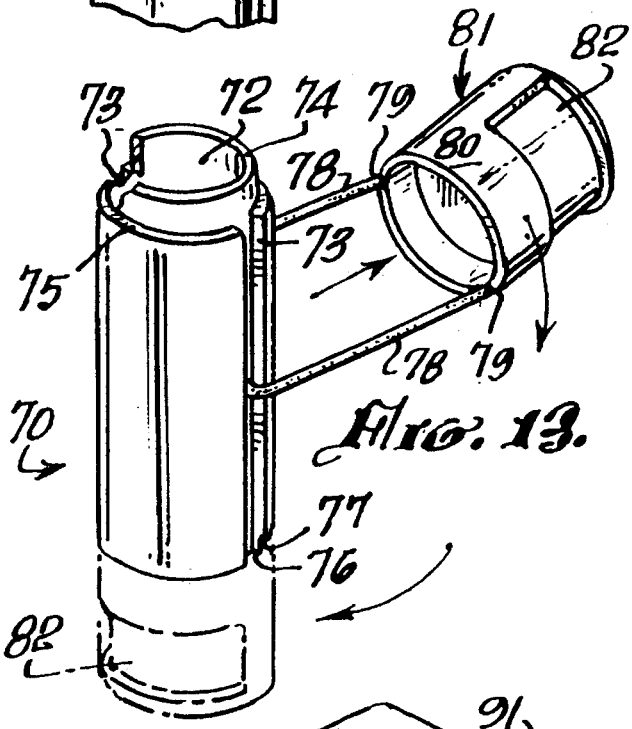
FIG. 13.
FIG. 14.
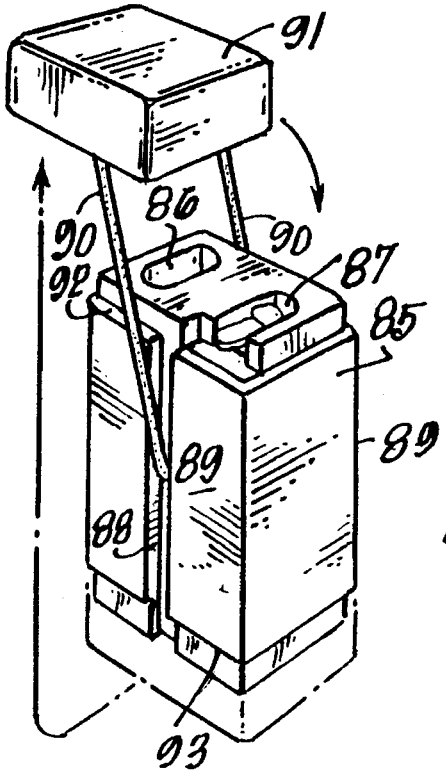
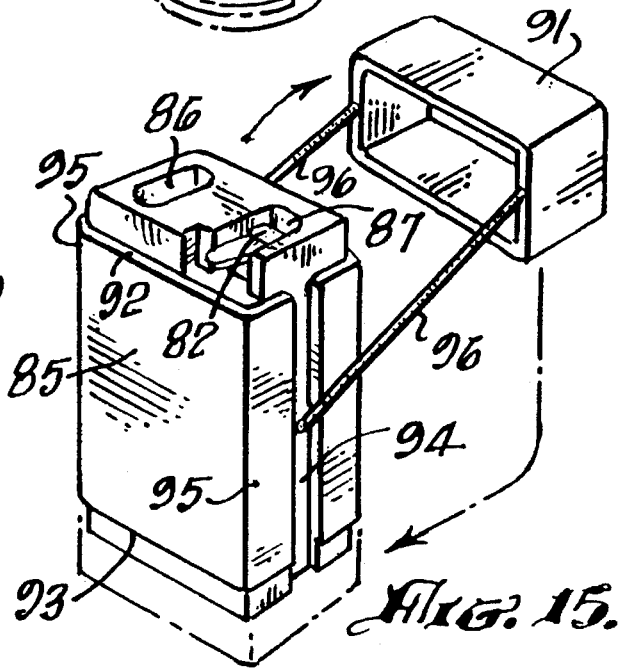
FIG. 15.

CADDY

TECHNICAL FIELD

This invention relates to a portable accessory, directed to but not limited to being used with cigarette smoking, and particularly relates to a portable pocket ashtray combined with a lighter and cigarette holder, or in short, a caddy.

PROBLEMS SOLVED BY THE INVENTION

With cigarette smoking, a problem that surfaces is what to do with the ashes from, filters of and/or butts from, the cigarette, while smoking, when an ashtray is not readily available. Also, the need for another important fundamental, a cigarette lighter, is present. Finally, the matter of the ashtray in one hand, the holding of a cigarette in the other hand, and the required first need for lighting the cigarette, complicates the situation for the smoking person. Particularly, in this day and age, much negativism about smoking makes it difficult for the smoking person to find a location where ashtrays, lighters, matches are made readily available. Such person should best be personally prepared with lighter, ashtray, cigarette holder, smoking articles, and ashtrays. The inventive concept in this invention solves these complications and problems, particularly by providing a most practical and efficacious disposition for the smoking article, its required lighting implement, a receptacle for ashes and one for holding the smoking article as well, the receptacle for ashes also being available for storing a partially smoked article for use once again at a later time. Also, unnecessary concern, while enjoying a cigarette or the like, over the separate and detached disposition of the caddy's lid from its case, and its whereabouts, is avoided, while at the same time an ashtray counter-part and cigarette holder are provided.

BACKGROUND TO THE INVENTION

Various prior art teachings disclose cases, compartments in them, cigarette lighters in them, etc., however none of them teach or suggest this invention which as its description unfolds herein embraces a broader field of application than that particularly disclosed in the drawing and its accompanying description. I.e., the inventive concept is not limited to applications concerned with smoking articles, but also is applicable to many other uses. Prior art teachings of caddys relating particularly to smoking articles are found in U.S. Pat. Nos. 1,587,468; 1,992,421; 2,582,598; 2,715,961; 2,777,569; 3,888,264, 4,190,148; 4,993.435; 4,588,076; and 4,789,059.

SUMMARY OF THE INVENTION

The specific nature of the illustrated embodiments of this invention pertains to a smoker's convenience caddy for lighting a cigarette, for depositing cigarette ashes into it, for effectively retaining and positioning its lid or cover out of the way yet still presently, instantly, immediately, and directly available to the caddy while the caddy is being used, and for holding the cigarette or other smoking article while not smoking it. The lid is attached to the main case or body of the caddy by means of one or more elastic-like connections, such as by one or more bungee cords, springs, or other stretchable elements. The lid pivots about the case from a position that closes the top of the case to a position on the bottom of the case, out of the way on the bottom while the caddy is being used, yet not being totally separated or unconnected from the caddy but available in the manner indicated above. The size of a caddy embodying the inventive concept need not be limited to the sizes depicted by the illustrations in the drawing, as other applications of it and its uses are applicable in other areas. The general storing of articles and the collection of waste (other than ashes from a smoked article) for disposal are examples of such other areas.

An object of this invention is to provide a novel caddy and a novel carrying case.

Another object of this invention is to provide a convenient disposition for the lid of a case for a caddy and/or carrying case of any suitable size and particularly as applied to a caddy sized for association with cigarette smoking or the like.

Another object of this invention is to solve the heretofore problem of the whereabouts of a lid to a caddy case, before, during and after use of the caddy.

Another object of the invention is to provide in the caddy a way to hold a burning cigarette or other smoking article.

A further object of this invention is to provide a novel storage device applicable for many or an innumerable number of uses.

Another object of this invention is to clean up the planet Earth of a major visual and environmental pollutant, known as filters and butts of smoking articles.

These and other objects and advantages will become more apparent upon a full and complete reading of the following description, the appended claims thereto, and the accompanying drawing comprising five (5) sheets of seventeen (17) FIGURES.

BRIEF DESCRIPTION OF THE DRAWING

FIG. 8 is a perspective view of an alternate embodiment of the invention.

FIG. 9 is a view taken on line 9—9 of FIG. 8.

FIG. 10 is a view taken on line 10—10 of FIG. 9.

FIG. 11 is a perspective view of another embodiment of the invention.

FIG. 12 is a fragmentary perspective view of the FIG. 11 embodiment in an actuated mode.

FIG. 13 is a perspective view of the FIG. 11 embodiment yet in another stage of the actuated mode.

FIG. 14 is a perspective view of another embodiment of the invention.

FIG. 15 is a perspective view of still another embodiment of the invention.

BEST MODE OF CARRYING OUT THE INVENTION

Figures 1, 2, 3, 4:
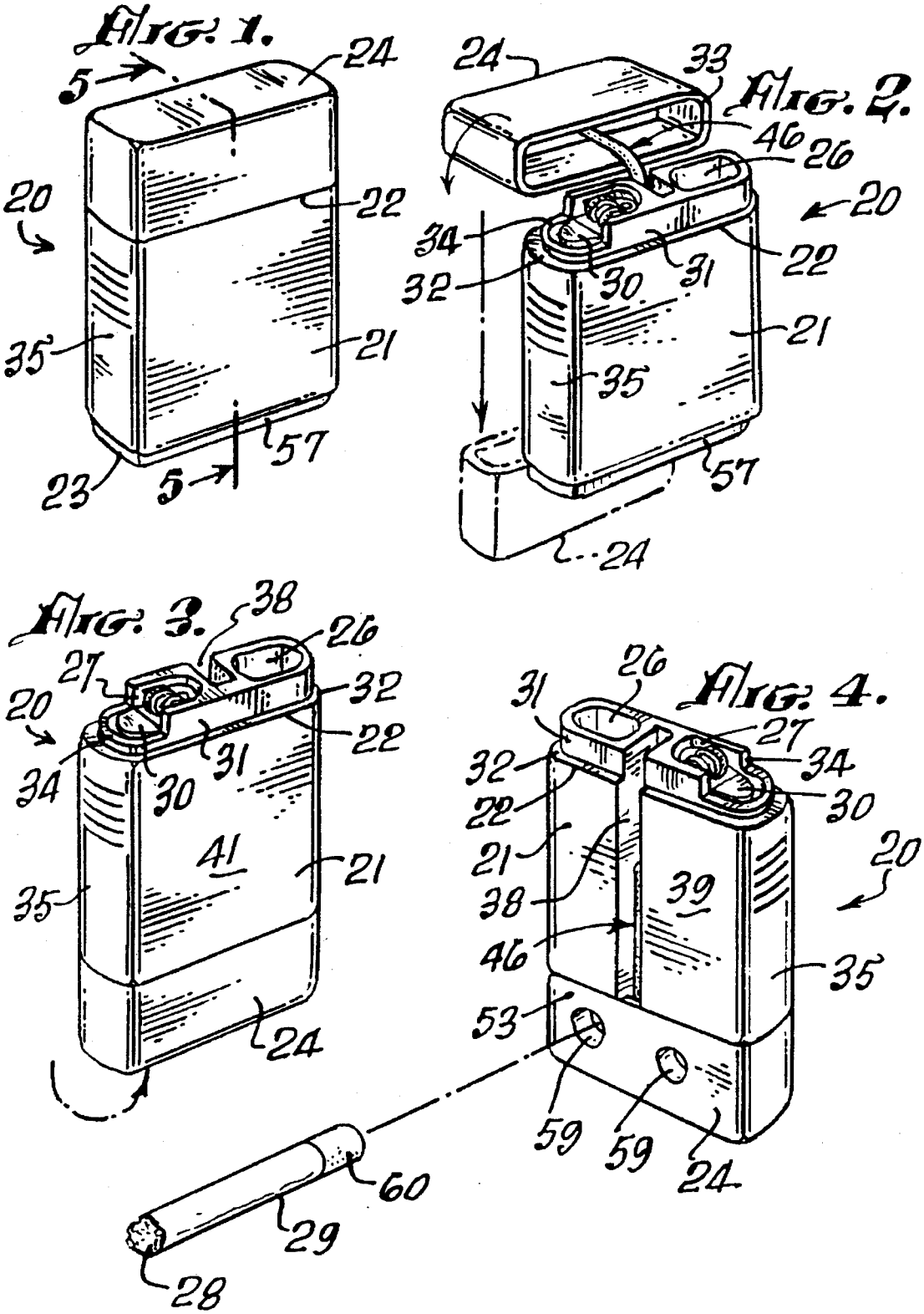
FIG. 1 is a front perspective view of a caddy embodying the invention.
FIG. 2 is a front perspective view of the caddy with its lid disposed away from its top but not unconnected from the caddy.
FIG. 3 is a front perspective view of the caddy with its lid disposed in its position at its bottom.
FIG. 4 is a rear perspective view of the caddy, generally that of the rear of FIG. 3, again with its lid disposed in its position at its bottom.
Figure 5:
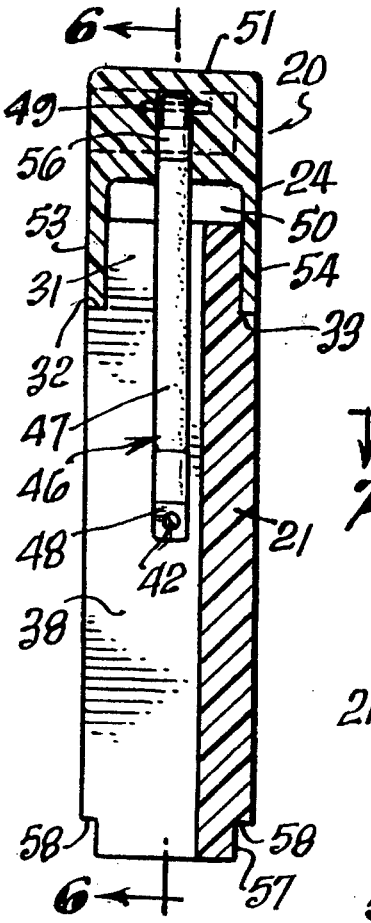
FIG. 5 is a sectional view taken on line 5—5 of FIG. 6.
Figure 6:
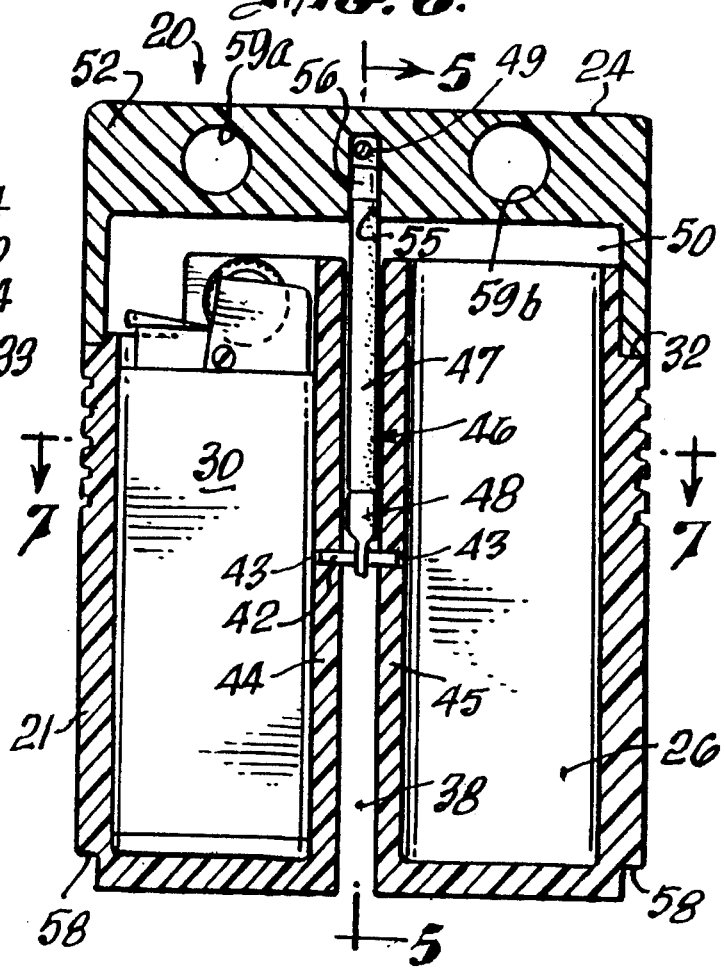
FIG. 6 is a sectional view taken on line 6—6 of FIG. 5.
Figure 7:
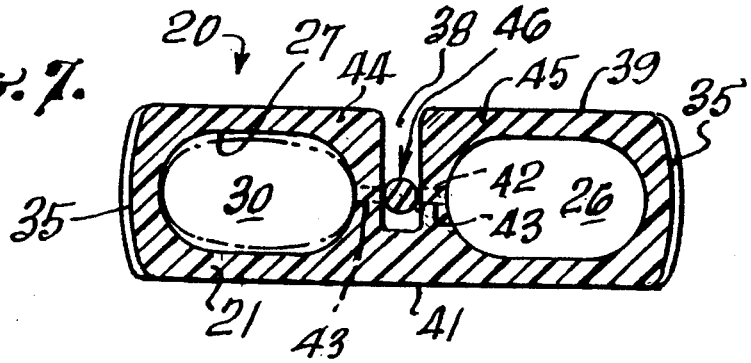
FIG. 7 is a sectional view taken on line 7—7 of FIG. 6.

Referring to the drawing wherein reference characters correspond to like numerals hereinafter, FIGS. 1–7 illustrate a caddy 20 embodying the invention. Caddy 20 comprises a case or body 21 of a volumetric proportion in its length that has a top or upper end 22 and a bottom 23. A lid 24 is mounted or disposed over one or more pockets or chambers formed in the length of case 21, between its top 22 and bottom 23, here shown as two (2) generally end-to-end pockets 26, 27. Pocket 26 provides for deposit of ashes 28, FIG. 4, from a cigarette 29, while pocket 27 provides for introduction thereinto of a lighter unit 30 that is adapted to snugly, frictionally, or fixedly engage the wall formation in the length of the case or body 21 forming its pocket 27. Body 21 includes a reduced body portion 31 at its upper end 22 and by which a shoulder 32 is formed and on to which the endless peripheral edge 33, FIG. 2, of the lid 24 seats when the lid closes off the top or upper end 22 of the caddy. A cut-out section 34 in the reduced body portion 31, adjacent one of opposing sides 35 of the body 21 and in proximate relation to pocket 27, provides for ingress of a finger (not shown) to actuate, in a usual manner, the lighting mechanism of a lighter unit 30 when installed in its pocket 27. The lighter unit in its installation in pocket 27 is so oriented that the finger can ingress the cut-out section 34 to actuate the unit. An example of a lighter unit 30, it being the well-known spark-wheel-and-flint type with finger tab actuation, available today for use in pocket 27 is a BIC lighter, manufactured and sold by the BIC Corporation, Milford, Conn. 06460.

A slot 38, FIGS. 4–7, is formed in a face 39 of the body 21, preferably midway between its two thin sides 35, extending longitudinally of and inwardly from the body's face 39. Its inward extension preferably extends somewhat past the half-way mark in the thickness of the body 21, FIG. 7, between its face 39 and its second face 41 opposing face 39. Approximately at one-half the length of slot 38, a roll pin 42, FIGS. 5, 6, spans the space forming the slot 38 and is held in such position by its end portions fitting in holes 43, FIG. 6, formed in the body 21's thickness that constitutes the body formation 44, 45 for both the slot 38 and portions of the walls forming their respective pockets 26, 27. A stretchable or elastic means 46, illustrated here as a bungee cord 47, is mounted to the pin 42 by means of an eyelet member 48 crimped to the one or lower end of the bungee cord 47. The bungee cord 47 extends to the lid 24 to which it is attached by mean of a pin 49. The lid 24 includes a hollow chamber 50 having a height which extends from the plane of the lid's peripheral or bottom edge 33 towards its top surface 51, FIG. 6, sufficiently upwardly to accommodate the depth of the reduced portion 31 in the body 21 of the caddy. The lid 24 includes a solid body portion 52 that provides for a permanent positioning for the pin 49, disposed generally midway between its side faces 53, 54, FIGS. 5, 6, the pin 49 being in general parallel alignment in its length with the faces 39, 41, FIG. 7, of the body 21. An internal bore 55 extending from the hollow chamber 50 upwardly through the lid's body portion 53 provides installation of an eyelet 56 crimped to the other or upper end of the bungee cord 47 for mounting on pin 49, FIG. 6.

At the bottom 23 in the length of the body 21, a reduced portion 57 is formed, generating in turn an endless shoulder 58 having a dimension substantially the same as that of the bottom edge 33 of the lid 24.

With the bungee cord 47 thus pivotally connected between the lid 24 and the body 21 of the caddy 20, it now is apparent that the lid 24 is constantly drawn towards the body 21 and is extended therefrom only when it is pulled against the biasing effect of the elastic mean 46, the bungee cord 47 in this embodiment.

Thus, the lid 24 and the body 21 of the caddy 20 are inseparable, this being true for every embodiment of the invention.

Included also in the lid 24 are one or more mouths 59, FIG. 4, located in its one side face 56. The mouths 59 are sufficiently deep in the solid body portion 52 of lid 24 to support and hold the filter or lip ends 60, FIG. 4, of cigarette 29 or of another smoking article, for example, a cigar.

Consequently, the caddy 20 functions as a holding member for a smoking article, with the article in a mouth 59 when it is lit (or unlit), as well as an ashtray for ashes, filters and butts via pocket 26.

It may be noted from an inspection of the lid's faces 53, 54, illustrated in FIGS. 2 and 4, that an error would appear to be in the illustrations. However, such is not the case, as the lid 24 in FIG. 2 has been swung 180° about the bungee cord 47 in its travel to its slot disposition in FIG. 4, so that the mouths 59 on side face 56 (not seen in FIG. 2) are seen in FIG. 4 by reason of such 180° swing. These illustrations of FIGS. 2 and 4 are intentional, to show that with a bungee cord 47, the lid may seat in either of two ways on either of the shoulders 32 and 58 of the body 21.

In operation, assume that the edge 33 of the lid is seated over the upper reduced portion 31 of the body 21 of the caddy 20, the elasticity of the bungee cord 47 maintaining this closed mode (lid on top of case) of the caddy 20. One hand (not shown) of a person grasps the body 21 while the other hand (not shown) grasps the lid and pulls it in a direction away from the body to unseat the edge 33 from the shoulder 32 and to elevate the edge 33 to above the height of the reduced body portion 31 of the case or body 21. The lid 24 now is capable of being swung around and down towards the bottom 23 of the body 21 by reason of the bungee cord 47 that follows a planar trajectory that contains the confines of the slot 38. Travel of the lid continues, with the bungee cord in a more relaxed mode than its mode when held on the lid on the body's shoulder 32, until it is in a position for its edge 33 to seat on the shoulder 58 at the bottom 23 of the body 21. The cord's trajectory has been completed and the bungee cord is once again within the confines of slot 39. The elastic bias of the bungee cord 47 maintains the lid at the bottom 23 of the body 21, as it had done when it held the lid to the top of the case on shoulder 32. The lighter unit 30 is now exposed for utilization, with no need for further conscious consideration by the operator. A cigarette or other smoking article 29 is lit (not shown) by the lighter unit 30. Ashes 28, cigarette lip end or filter 60 and butts (not shown) now are capable of being disposed in the pocket 26. At any time while smoking, as desired, the mouth-end 60 of the cigarette 29 may be placed in one of the mouths 59 in the lid 24. The caddy 20 may either be hand-held or it may be set upon a table or the like. Pocket 26 always is ready for ashes. Pocket 26 also is available for storing a once-lit but only partially smoked cigarette, until some later time when the person desires to once again smoke that particular cigarette (or other smoking article). In storing it in pocket 26, it has been found to go out upon its lit end being inserted into the pocket 26, because of an insufficient amount of oxygen entering under the lid to maintain its light.

Whenever the smoking person desires to no longer utilize the caddy as described immediately above in its operation, the lid is pulled from its seat on the bottom shoulder 58 and reserves its trajectory travel, towards the body's top, the bungee cord 47 again traversing its planar trajectory by reason of such travel. Once the lid is in alignment again with the top of the body, the bungee cord's condition of elasticity is released from the hand so that the lid's edge 33 can seat on the shoulder 32 about the reduced portion 31 of body 21.

Thus, with a lighted cigarette in one hand and the caddy in the other, the smoker is able to provide a portable holding member 59 for the cigarette (the mouth 59), an ashtray for ashes (pocket 26), and a chamber (pocket 27) for a lighter unit. And most important and practical, no overdue concern for the whereabouts of the lid 24 is manifested as it is always with the caddy and yet completely out of the way while the caddy is in use, and ready for use when necessary.

Alternate embodiments are illustrated in FIGS. 8–10. In FIG. 8, one or more clip members 62 are suitably attached, such as by rivets or other types of fasteners 63, to a face on the case or body, here, face 39. The caddy in this manner can be worn upon a belt or the like rather than placed in a pocket of a suit coat, pants, skirt or the like. In FIG. 9 embodiment, a coiled spring 64 is substituted for the bungee cord, its opposing curled end hooks 65, 66 attached to their corresponding roll pins 67, 68, respectively. Gasket means 69, FIG. 9, is mounted and suitably held in the hollow chamber 50, primarily over the pocket 26, to seal off any odor, when the caddy is in a closed mode, that may arise from ashes 28 or the like in pocket 26. The FIG. 10 embodiment illustrates that different sized mouths **59*a* and 59*b* for different sized smoking articles can be incorporated into the lid 24**.

FIGS. 11, 12, and 13 illustrate another embodiment 70. Caddy 70 comprises a hollow cylindrical body 71 of a longitudinal length that provides for a chamber 72 for the reception of ashes, partially smoked articles, and/or butts, and a pair of diametrically positioned slots 73 exteriorly mounted on and extending the length of the body 71. A reduced body band 74 atop the body 71 forms a shoulder 75 with the body 71. At the bottom 23 of body 71, another reduced body band 76, is formed thereon, forming a corresponding shoulder 77. Each of a pair of bungee cord means 78 are respectively pivotally mounted at their corresponding one ends to suitable fasteners, such as rivets (not shown), suitably fixed to the body 71 midway the length of their corresponding slots 73. Their corresponding other or upper ends are suitably attached as at 79 to a cylindrical wall 80 of a lid 81 that seats on either of the body's shoulders 75 or 77 in a manner like the lid'seating illustrated in FIGS. 1–7. Integrally within or otherwise mounted atop of the lid 81 is a lighter unit 82, such as the piezo kind that is available in the marketplace today.

In operation, assuming the caddy 70's chamber 72 is in a closed mode by the lid 81 seated on shoulder 75, a cigarette first is lit by the flame of lighter 82 as lighter 82 is actuated (shown by arrow 83, FIG. 12). Thereafter, the lid 81 is pulled away or up from its seated position on shoulder 75, stretching the two bungee cord means 78 sufficiently to elevate the bottom of the lid above shoulder 75. Lid 81 is swung downwardly to be repositioned to and on the shoulder 77 at the lower end or bottom of the caddy 70, after release of the stretched condition of the bungee cord means 78 so that the bottom of lid 81 seats on shoulder 77. In the trajectory of the bungee cord means 78, they wash with the sides of the cylindrical body 71 as lid 81 is being swung downwardly (or upwardly in a reversal of trajectory from shoulder 77). Once lid 81 is seated on shoulder 77, bungee cord means 78 once again are in their corresponding slots 73.

FIGS. 14 and 15 are illustrations of an embodiment wherein the caddy's body 85 is again rectangular in character, like that of FIGS. 1–7, however, different by the fact that the two chambers 86, 87 in each of such illustrations are side-by-side to one another rather than end-to-end to one another, as was illustrated in the FIGS. 1–7 embodiment. In the FIG. 14 illustration, slots 88 are formed in the caddy's outside walls 89 that oppose each other. The plane of walls 89 and their slots 88 are generally perpendicular to the parallel arrangement of the chambers 86, 87. Corresponding bungee cord means 90 are suitably pivotally attached to body 85 and to its lid 91. Upper and lower shoulders 92, 93 are formed in body 85. In the FIG. 15 illustration, the slots 94 are formed in the opposing outside walls 95 of the caddy's body 85. The plane of the walls 95 and their slots 94 are generally parallel to the parallel arrangement of its two chambers 86, 87. Corresponding bungee cord means 96 are suitably pivotally attached to body 85, within the slots 94. The manner of operation of the caddy of FIGS. 14, 15 is the same as in the previously described embodiments.

Figure 16:
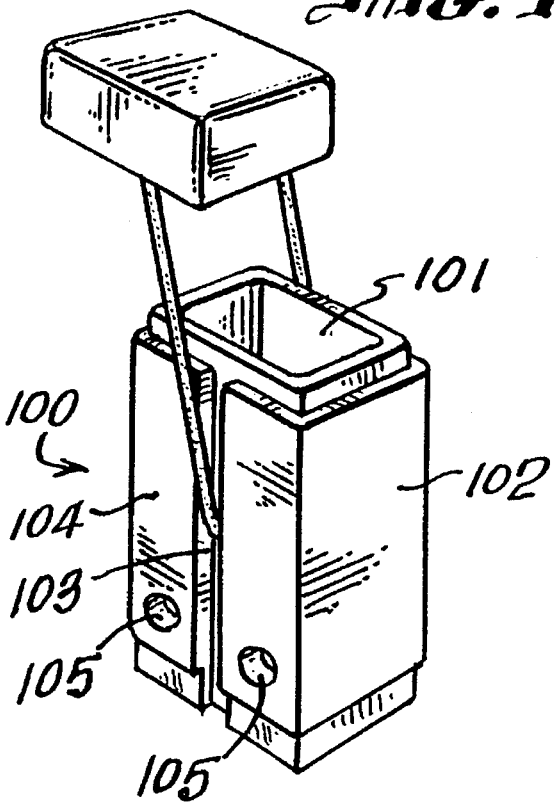
FIG. 16 is a perspective view of another embodiment of the invention.

FIG. 16 illustrates an embodiment 100. One pocket 101 is mounted in its body 102 that includes a pair of slots 103 [only of the two being shown in FIG. 16] opposing one another in opposing faces 104 [only one of the two being shown in FIG. 16]. One or more mouths 105, when more than one not necessarily being of the same size, are mounted in one or more of the faces 104.

Figure 17:
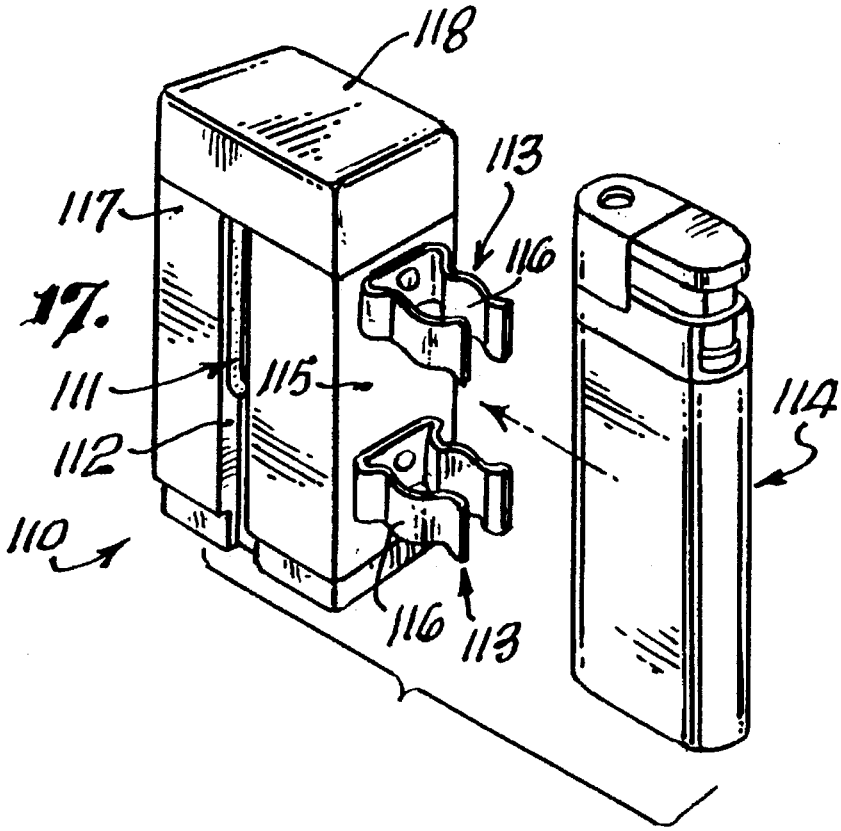
FIG. 17 is a perspective view of still another embodiment of the invention.

FIG. 17 illustrates an embodiment 110 having elastic means 111 mounted within its slot means 112, and also including means 113 for retaining a lighter unit 114 to a face 115 that doesn't include a slot or elastic means. An example of the retaining means 113 is shown as a pair of clips 116 spaced apart from one another each being securely mounted to face 115, such as by rivets or other suitable fasteners. The caddy 110, of course, may include one or more pockets in its body 117, as in the previously described embodiments, as well as having mouths for holding and supporting a smoking article in either its body 117 or in its lid 118.

In assembly of the caddy 20, holes 43 are bored by means of a boring tool (not shown) passing through one of the thin sides 35, after which the roll pin 42 is placed in the holes, the eyelet 48, already crimped on its bungee cord, being mounted on the roll pin as it is put into place. The bored hole in side 35 then is filled up with suitable material. Similarly, a hole (not shown) is bored through the lid 24, along an axial line for the axis of roll pin 49, and the eyelet 56, already crimped to the bungee cord, is threaded to such pin via the internal bore 55 as it seeks its position shown in FIG. 6. The lighter unit 30 is installed in its pocket 27, with its spark-wheel exposed in the cut-out section 34 in the reduced body portion 31. The lid 24 then is rotated about the lower pin 42, the bungee cord 47 stretched sufficiently to provide passage of the lid over the reduced body portion 31 in order for its edge 33 to seat on the shoulder 32 of the body or case. The gasket means 69, if used, has already been properly disposed within hollow chamber 50 of the lid 24, and one or more clips 66, if used, have already been securely mounted to the side of the case.

In the FIGS. 8–10 embodiment, clips 66 are attached by the rivets 63 to the body of the caddy 20 after its fabrication. Gasket means 69 is formed and fitted to the hollow 50 in the lid 24. Pin 67 is put into place by boring a bore through the lid 24, and as the pin is inserted into the bore and approaches its location the hook 65 is placed in its location in the bore to be mounted on the pin 67 as the pin reaches its location. Likewise, via a bore formed in the body of the caddy 65, pin 68 is located in its position, the hook 66 being mounted thereto as the pin approaches its location. These bores for the pins 67, 68 are or may not necessarily be plugged.

In the FIGS. 11–15 embodiments, the bungee cord means 90, 96 with their crimped end members are pivotally mounted to rivets or other suitable fasteners to their respective caddies bodies generally midway the lengths of their corresponding slots 88, 94 and are suitably attached at their other ends to their corresponding lids. In each of the embodiments illustrated, the lighter unit is later applied to its chamber and lid.

The FIG. 16 embodiment 100 is assembled in the same manner as the embodiments 14, 15, after but one pocket and one or more mouths being formed therein.

In the FIG. 17 embodiment 110, clips 116 are fixed to its face 115 at a convenient step in the assembly of its body 117, after which a lighter unit 114 is clipped thereto.

Suitable materials are used in making the caddies. The case or body, the lid, and their elements may be made out of metal, plastic, or rubber, using known machining and molding processes and techniques. The pins, eyelets, bungee cord and coiled spring are formed from suitable and known materials. Any suitable elastic means or material functioning in substantially the same way to achieve substantially the same result is as applicable to the invention as the illustrated bungee cords and coiled spring are, and may be substituted therefor.

Various changes and modifications may be made in the invention without departing from the scope and spirit of its inventive concept. The body of, or the one or more pockets or chambers in, the caddy need not be restricted to the geometrical shapes or configurations illustrated in the drawing. The slot or slots may be biased, i.e., slanted rather than strictly vertically oriented as shown in the drawing. The slot means, by way of example the slots 88 and 94, in the FIGS. 14, 15 illustrations, may be widened to one or the other of their corresponding faces 85, this being applicable to the other embodiments as well. In the FIGS. 11–13 embodiment, it should be understood that the half of its cylindrical case that accommodates or embraces one elastic means 78 is deemed to be an opposing face to the other half of the case in which another elastic means 78 is mounted. Also in the FIGS. 11–13 embodiment, the slots 73 may be omitted, and more than one (1) pocket can be included in the cylindrical case. In fact, the inventive concept of the invention embraces a physical tangibility that includes equivalents to the slots or slot means illustrated in the drawing but which are not slots or slot means as such. Clips 62 and the difference in mouth sizes 59*a*, 59*b*, as already indicated, need not be confined to their corresponding embodiments illustrated by FIGS. 8 and 10. The pocket 27 need not be utilized exclusively for a lighter unit 30 [or even ordinary matches]; for example, it may be used for storing fresh articles to be smoked, while the other pocket 26 is used for ashes. The gasket means 69 can be mounted in the lid of any embodiment, and merely over, if desired, the pocket that is adapted to carry ashes. And its equivalent or substitute, an O-ring, can be mounted on the caddy's body, preferably upon a shoulder like that at 32 of a body for the caddy. The mouths 59 may be one or a plurality, of one or more different sizes in a given caddy, and may be formed in either of or both side faces 53, 54 of the lid 24, or in the body of the caddy itself, and even formed across one or more slots and within the formation of the body of the caddy itself. One or more clip members 62 may be mounted to face 41 rather than to face 39. The retaining means or clips 113 can be affixed to the lid 118 or other feasible lid as well, on one of their exterior faces. Suitable elastic means other than the bungee cords, roll pins, eyelets and springs may be utilized as stretchable means.

INDUSTRIAL APPLICABILITY

The invention is useful in the tobacco accessory and fine arts, though not limited thereto. It can be useful, say, in the refrigeration arts where only one chamber would appear to be necessary to maintain a temperature, cold or hot, desired to be held in regard to stored food (one or more food articles) in a single chamber or even to store it in multiple chambers or pockets. Further, the invention is applicable to many applications involving cases for carrying other articles or the like.

I claim:

1. A caddy comprising a body having opposing faces and a length and a top and a bottom and one or more pockets from within the top, a lid seatable upon said body at the top of said body and at the bottom of said body, a slot formed in at least one of said opposing faces extending the length of the body, elastic connecting means mounted in said slot, and means pivotally attaching said elastic connecting means to said body and to said lid, said lid pivotable between its seat at the top of the body and its seat at the bottom of the body, said elastic connecting means providing inseparableness between said lid and body and stretching so that said lid can pivot to seat said lid either on said top or bottom of said body.

2. The caddy of claim 1 wherein said elastic connecting means comprises a bungee cord.

3. The caddy of claim 1 wherein said elastic connecting means comprises a coiled spring.

4. The caddy of claim 1 or claim 2 or claim 3 including a reduced body portion at the top of the body thereby forming a shoulder for seating the lid thereon.

5. The caddy of claim 4 including a reduced portion at the bottom of the body thereby forming a shoulder for seating the lid thereon.

6. The caddy of claim 5 wherein said lid includes a peripheral edge above which is disposed a hollow chamber below a solid portion in the lid, said elastic connecting means mounted to said solid portion through the hollow chamber.

7. The caddy of claim 5 including at least one mouth mounted in said body.

8. The caddy of claim 7 wherein said mouth is formed across said slot.

9. The caddy of claim 1 or claim 2 or claim 3 including a reduced portion at the bottom of the body thereby forming a shoulder for seating the lid thereon.

10. The caddy of claim 1 or claim 2 or claim 3 wherein said lid includes a peripheral edge above which is disposed a hollow chamber below a solid portion in the lid, said elastic connecting means mounted to said solid portion through the hollow chamber.

11. The caddy of claim 1 or claim 2 or claim 3 having a second pocket from within its top.

12. The caddy of claim 1 or claim 2 or claim 3 including at least one mouth mounted in said lid.

13. The caddy of claim 1 or claim 2 or claim 3 including at least one mouth mounted in said body.

14. The caddy of claim 13 wherein said mouth is formed across said slot.

15. The caddy of claim 1 or claim 2 or claim 3 including a lighter unit mounted in said lid.

16. The caddy of claim 1 or claim 2 or claim 3 including retaining mounted on said body.

17. The caddy of claim 1 or claim 2 or claim 3 including retaining means on said lid means.

18. In a carrying case having a body with a top and a bottom and faces opposing one another between said top and bottom and at least one pocket therein and a lid for the body, the improvement comprising at least one slot in one of said faces and extending the length of said body, an elastic connecting means mounted in at least one slot, and means pivotally connecting said elastic connecting means to said body and to said lid.

19. In the improvement of the carrying case of claim 18, each of said faces including the slot extending the length of said case, elastic connecting means mounted in each such slot, and means pivotally connecting each of said elastic connecting means to said body and to said lid.

20. The improvement of claim 18 including a reduced body portion at the top of the body thereby forming a shoulder for seating the lid thereon.

21. The improvement of claim 18 including a reduced portion at the bottom of the body thereby forming a shoulder for seating the lid thereon.

22. The improvement of claim 21 including a reduced body portion at the top of the body thereby forming a shoulder for seating the lid thereon.

23. In a carrying case having a body, a lid, and at least one pocket in the body, the improvement comprising a slot in and extending the length of said body, elastic connecting means connecting said lid to said body, and means in said slot and in said lid pivotally connecting said elastic connecting means to said body and to said lid.

24. A caddy comprising a case having at least one pocket therein and with a top and a bottom, a lid seatable upon said top and upon said bottom, a pair of slots formed in said case in opposing relation to one another and extending the length of the case, elastic connecting means mounted in each one of said pair of slots, and means pivotally attaching each said elastic connecting means to said body and to said lid, whereby the lid by means of said elastic connecting means is pivotable between its seat at the top of the body and its seat at the bottom of the body, said elastic connecting means providing inseparableness between said lid and body and stretching so that said lid can pivot to seat said lid either on said top or bottom of said body, and a lighter unit mounted on said lid.

25. The caddy of claim 24 wherein said case is cylindrical.

* * * * *

UNITED STATES PATENT AND TRADEMARK OFFICE

CERTIFICATE OF CORRECTION

PATENT NO. : 5,605,226

DATED : Feb. 25, 1997

INVENTOR(S) : William J. Hernlein

It is certified that error appears in the above-indentified patent and that said Letters Patent is hereby corrected as shown below:

On the title page:

In the ABSTRACT [57], its line 10, "bliss" is to be read as -- bias --.

In Col. 1, line 25, cancel "and ashtrays."; read -- and -- before "smoking".

In Col. 5, line 4, "reserves" is to be read as -- reverses --.

In col.6, line 57, the ref. character "66" is to be read as -- 62 --.

In col. 6, line 59 the ref. character "66" is to be read as -- 62 --.

In col. 8, line 6, "fine" is to be read as -- fire --.

UNITED STATES PATENT AND TRADEMARK OFFICE

CERTIFICATE OF CORRECTION

PATENT NO. : 5,605,226

DATED : Feb. 25, 1997

INVENTOR(S) : William J. Hernlein

It is certified that error appears in the above-indentified patent and that said Letters Patent is hereby corrected as shown below:

In col. 9, line 9, "retaining" is to be read as -- retaining means --.

In col.9, line 11, "lid means" is to be read as -- lid --.

Signed and Sealed this

Twenty-ninth Day of July, 1997

Bruce Lehman

*Attest:*

BRUCE LEHMAN

*Attesting Officer*

*Commissioner of Patents and Trademarks*